United States Patent [19]

Sudol

[11] Patent Number: 5,033,545

[45] Date of Patent: Jul. 23, 1991

[54] CONDUIT OF WELL CLEANING AND PUMPING DEVICE AND METHOD OF USE THEREOF

[76] Inventor: Tad A. Sudol, 11724 - University Avenue, Edmonton, Alberta, Canada, T6G 1Z5

[21] Appl. No.: 261,897

[22] Filed: Oct. 25, 1988

[30] Foreign Application Priority Data

Oct. 28, 1987 [CA] Canada ..... 550410

[51] Int. Cl.[5] ..... E21B 37/00; B08B 3/02; B08B 9/02

[52] U.S. Cl. ..... 166/312; 134/167 C; 166/68; 166/77; 166/105; 166/222; 166/223

[58] Field of Search ..... 166/68, 222, 223, 312, 166/369, 105, 372, 77; 134/167 C, 167 R; 175/24, 67, 424

[56] References Cited

U.S. PATENT DOCUMENTS

| | | | |
|---|---|---|---|
| 1,658,697 | 2/1928 | Wiesman | 166/223 X |
| 2,368,346 | 1/1945 | Coberly | 166/369 |
| 2,660,250 | 11/1953 | Gage et al. | 166/222 X |
| 2,758,653 | 8/1956 | Desbrow | 175/424 X |
| 2,771,141 | 11/1956 | Lewis | 166/222 |
| 3,101,784 | 8/1963 | Davidson | 166/312 X |
| 3,316,985 | 5/1967 | Fly | 175/24 |
| 3,547,191 | 12/1970 | Malott | 166/223 |
| 3,822,750 | 7/1974 | Ping | 166/312 X |
| 4,074,779 | 2/1978 | Cheung et al. | 175/67 X |
| 4,302,052 | 11/1981 | Fischer | 175/67 X |
| 4,310,288 | 1/1982 | Erickson | 417/54 |
| 4,348,058 | 9/1982 | Coakley et al. | 175/67 X |
| 4,349,073 | 9/1982 | Zublin | 166/312 |
| 4,420,187 | 12/1983 | Hodges | 175/67 X |
| 4,442,899 | 4/1984 | Zublin | 166/222 X |
| 4,495,996 | 1/1985 | Meyers et al. | 166/312 X |
| 4,580,634 | 4/1986 | Cruise | 166/312 X |
| 4,605,069 | 8/1986 | McClaflin et al. | 166/310 |
| 4,671,359 | 6/1987 | Renfro | 166/223 X |
| 4,718,728 | 1/1988 | Hodges | 175/67 |
| 4,744,420 | 5/1988 | Patterson et al. | 166/312 |

*Primary Examiner*—Stephen J. Novosad
*Attorney, Agent, or Firm*—Davis, Bujold & Streck

[57] ABSTRACT

The device employs the jet pump principle to bring a power fluid to sedimented solids and the like plugging a conduit, and it includes at least one nozzle which directs the power fluid in a high-velocity jet against the solids to bring the solids into suspension for subsequent removal thereof using the jet pump principle.

26 Claims, 10 Drawing Sheets

FIGURE 1
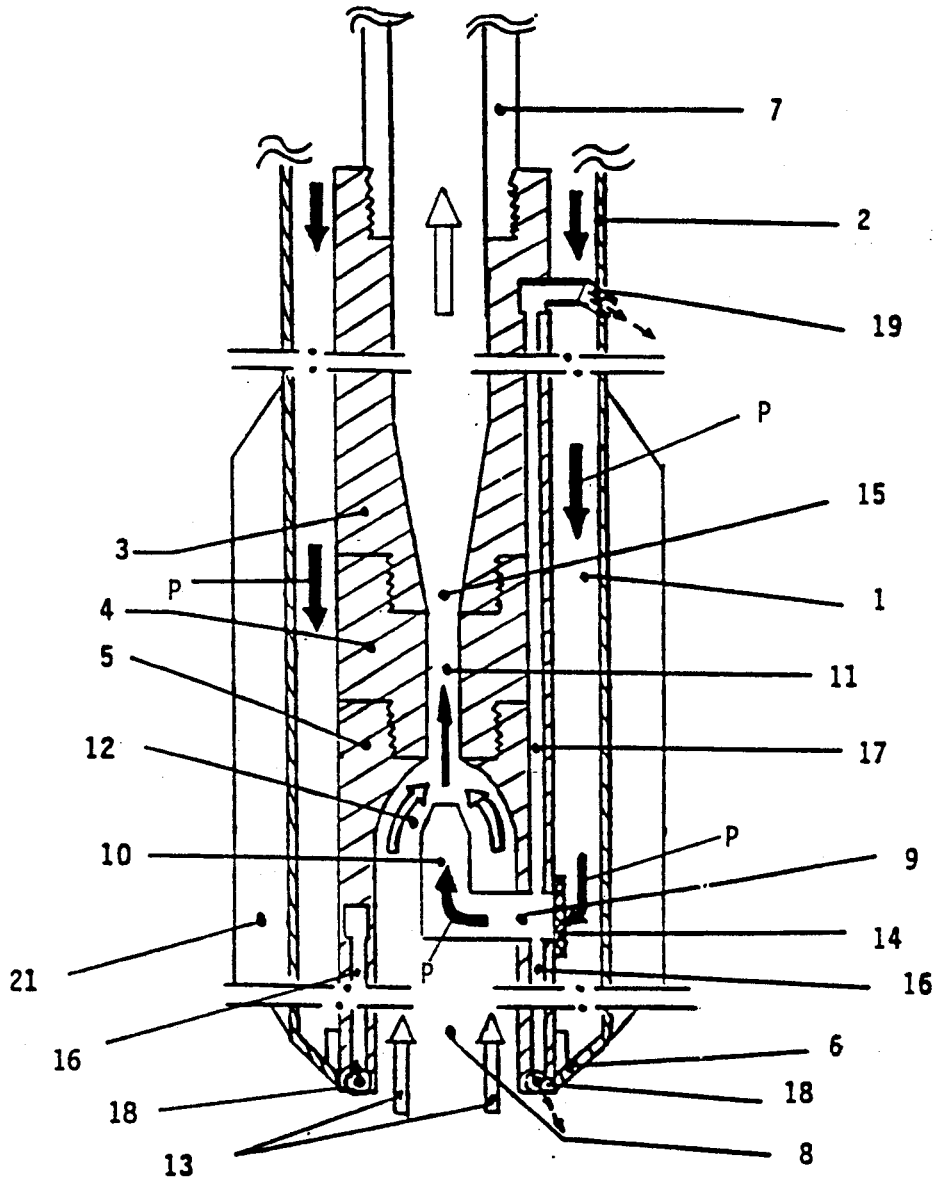
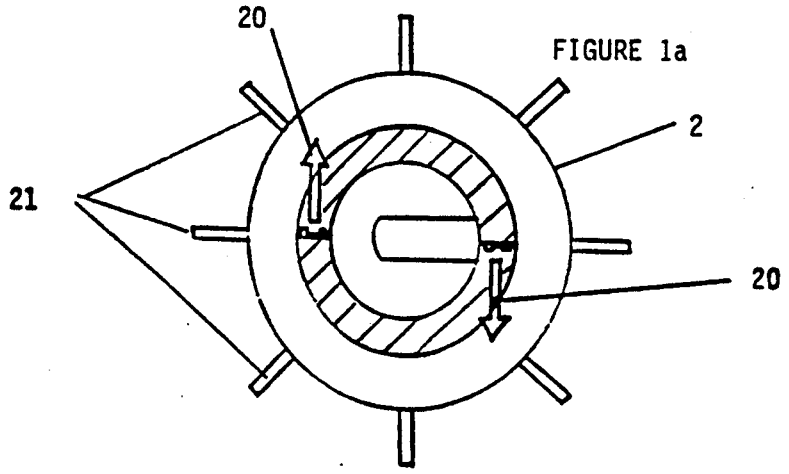
FIGURE 1a

FIGURE 6
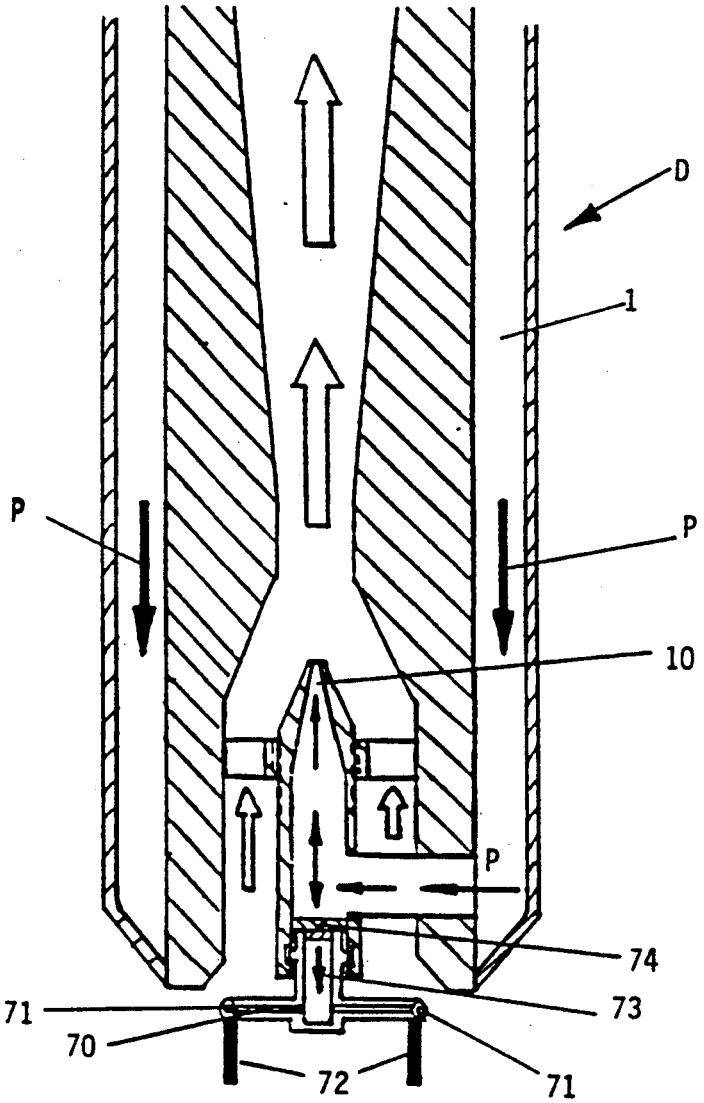
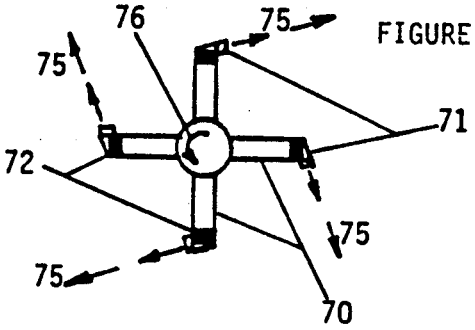
FIGURE 6a

CONDUIT OF WELL CLEANING AND PUMPING DEVICE AND METHOD OF USE THEREOF

FIELD OF THE INVENTION

My invention relates to cleaning of conduits, for example wells, such as vertical, deviated, horizontal or inclined wells and with which alternatively production can be pumped.

More particularly, my invention relates to a device for cleaning plugged conduits and a technique of solids removal from such conduits.

One application of my invention may be in an oil-field well-bore which has become plugged with sand or hard particles.

More specifically, for removal of well production, i.e., fluids from a respective reservoir, a reasonable level of permeability must be maintained at the producing interval of the well. This means that small particles of solids (sand) can also enter with the production fluids into the well-bore. The influx-process can progress to the state where a full clean-out of the plugged location will be required in order to maintain the production.

Especially production from oil wells that are drilled into unconsolidated reservoirs (sands) may be accompanied by an influx of solids in spite of efforts to control this.

Some of the known methods of sand control which are now utilized in the field include the use of screens, sand screens, slotted liners and gravel packs.

Conventional methods for removal of such solids may involve work-over during which the sand is removed by bailing. Another method involves running in endless tubing to the plugged location and applying fluid under pressure and recirculating the fluid with picked-up solids through the annulus formed between the endless tubing and the well casing. However, this pressurizing activity might result in damages to the reservoir.

The objects of my invention include:

To provide a very simple and effective device and method for cleaning a plugged conduit.

To provide a very simple and effective device and method for removing solids through a production tubing or conduit.

To provide protection to vital components at the orifice of the device.

In accordance with one aspect of my invention there is provided a device for cleaning a plugged conduit which employs the jet pump principle and which includes at least one nozzle which nozzle can direct a high-velocity fluid jet against the plugged location to disperse and fluidize the solids material that is plugging the conduit. The solids are then removed with the introduced fluid and production fluids using the jet pump principle.

Several specially arranged nozzles can also be used to direct high-velocity fluid jets against accumulated solids materials for dispersing and fluidizing the solids and subsequent removal thereof to the surface.

Thus, the device provides a cleaning action whereby solids may be broken up to fines and removed from the plugged location by the conveying fluid.

The intensity of the cleaning action may be adjusted to meet the requirements of particular existing conditions.

In accordance with another aspect of my invention there can be provided a liquid film or shield of liquid to protect vital components at the orifice of the device, such as the venturi throat, against the abrasive action of the stream of fluidized solids which is being pumped up to the surface.

In the case of an oil well, the cleaning and conveying fluid can be the power fluid as is usually employed in jet pumps for lifting of the production from a formation.

BRIEF DESCRIPTION OF THE DRAWINGS

The foregoing and other objects and features of my invention will become apparent with the following detailed description of the device and its function as illustrated by the accompanying drawings.

FIG. 1 is a schematic longitudinal cross section of the device in accordance with one embodiment;

FIG. 1*a* is a bottom view of the device according to FIG. 1;

FIG. 6 is a cross section of the device with rotating cleaning nozzles and blades;

FIG. 6*a* is a bottom view of the embodiment of FIG. 6;

DETAILED DESCRIPTION

Figure 2:
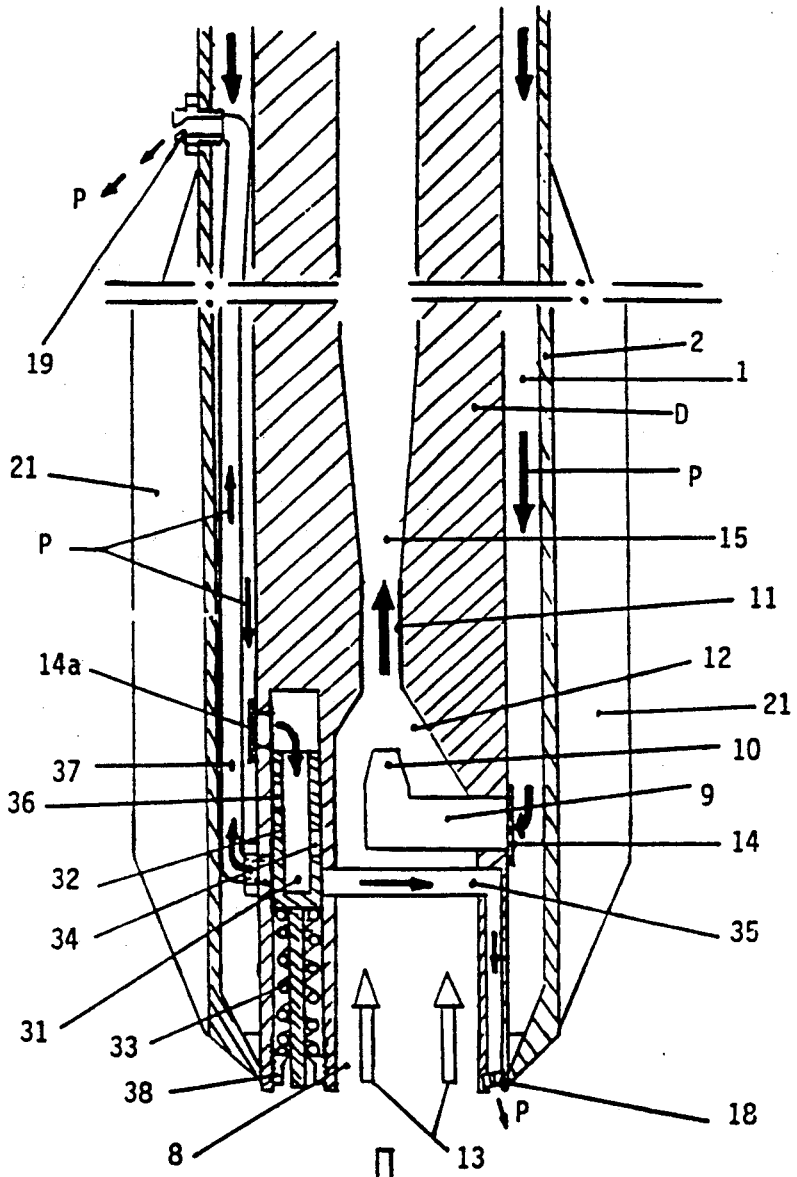
FIG. 2 shows a cross section of an embodiment of the device which can direct the power fluid selectively to cleaning nozzles to provide forward or reverse cleaning and pumping modes.

With reference to FIG. 1, a power fluid (arrows P) is admitted under pressure to an annular space 1 between an outer pump casing 2 and a jet pump device body, comprising an upper member 3, a central member 4 and a lower member 5. This annular space 1 is closed off at its lower end 6, for example by a packer, seal assembly, or weldment.

In the general installation shown in FIG. 1, a production tubing 7 is attached at the top of the jet pump device body, namely upper member 3, with appropriate threaded connections.

The jet pump includes a lowermost well-fluids inlet port 8 and one or several lateral power-fluid inlet ports 9, for admitting power fluid to the main nozzle 10 of the pump. The main nozzle 10 discharges into a throat area 11 of the pump assembly. Well-fluids passages 12 are provided in fluid communication with the well-fluids inlet port 8 for admitting well fluids to the throat area 11.

Well fluids, or a mixture of fluids and solids, generally flow under formation pressure in the direction of the arrows 13 to the fluid passages 12. Power fluid, under high pressure in the annular space 1, passes in the direction of the arrows P through a screen or filter 14 and the power fluid inlet ports 9 into the main nozzle 10. The power fluid is jetted from the main nozzle 10 into the high velocity passage 15.

Channel 16 admits the power fluid to one or several cleaning nozzles 18 at the bottom of the device, and channel 17 admits the power fluid to an upper nozzle or nozzles 19.

The power fluid is violently mixed with the well fluids and solids in the throat area 11 as well as in the high velocity passage 15.

The mixture comprised of power fluid, well fluids and solids then moves through the production tubing 7 which extends to the production equipment at the surface.

The power fluid is jetted through the cleaning nozzles 18 and 19 for agitating and fluidizing solids, which can then be passed through the inlet port 8 and thence through the throat area 11.

Figure 3:
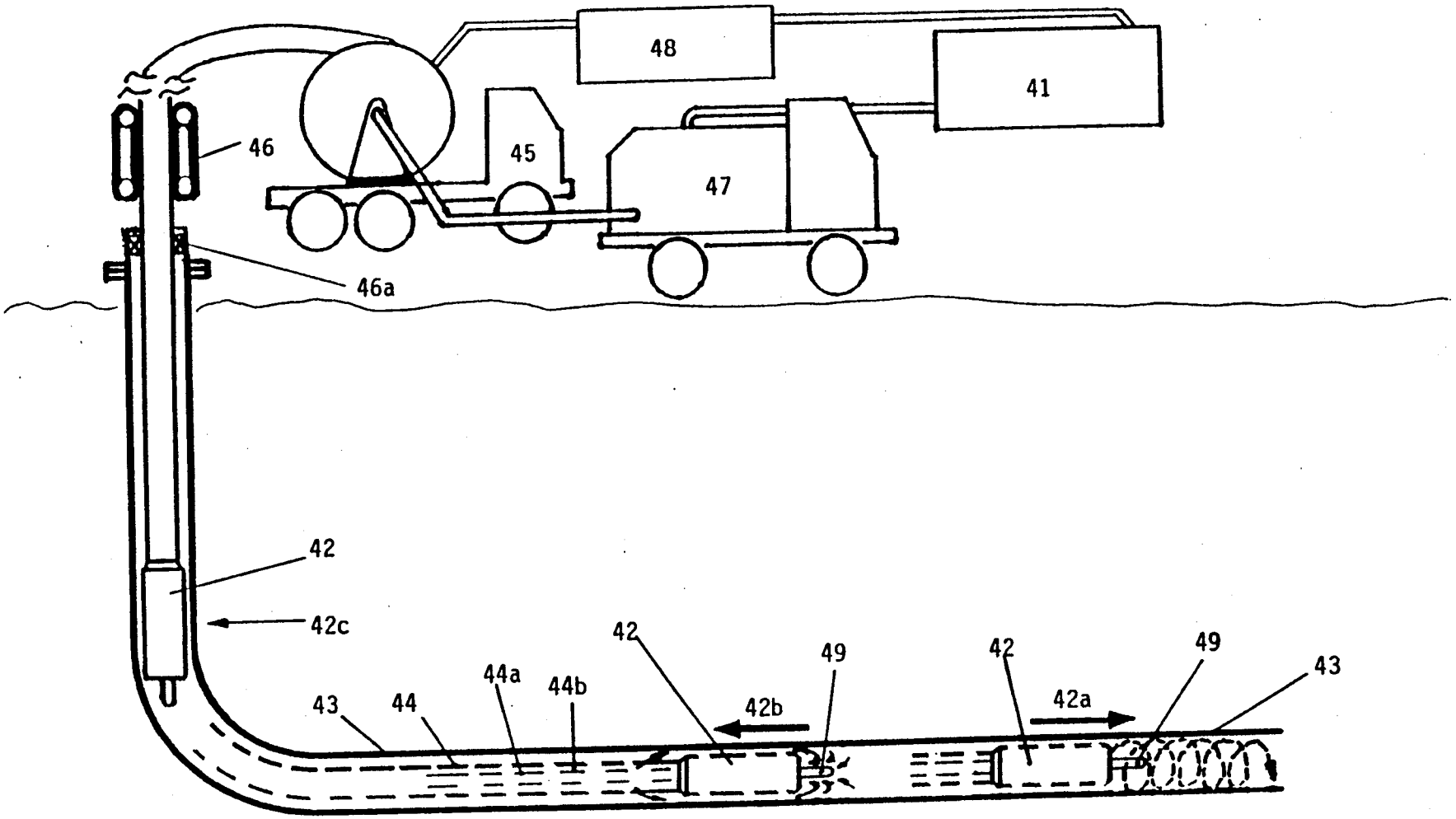
FIG. 3 shows an horizontal well application of the device.

One preferred direction of the upper nozzles 19 and lower nozzles 18 is such so as to supply fluid in tangential manner, see arrows 20 in FIG. 1*a*, when viewed in plan, towards the wall of the well casing not shown, and then the fluid starts a spinning effect as is more clearly shown in FIG. 3. The nozzles 18 and 19 produce high-velocity jets, to agitate solids and generate a high velocity spinning of the well-fluids. The spinning motion keeps solids in suspension till they are pumped out.

Centralizers or spacers 21 are secured so as to be radially projecting at the casing 2 of the device.

FIG. 2 shows a device which generally includes the same elements as described with reference to the embodiment shown in FIG. 1. Thus, the device includes the annular space 1 between the outer pump casing 2 and the jet pump device body, generally identified by reference character D.

The jet pump includes the lowermost well-fluids inlet port 8 and one or several lateral power-fluid inlet ports 9, for admitting power fluid to the main nozzle 10 of the pump. The main nozzle 10 discharges into a throat area 11 of the pump assembly. Well-fluids passages 12 are provided in fluid communication with the well-fluids inlet port 8 for admitting well fluids to the throat area 11.

Well fluids, or a mixture of fluids and solids, generally flow under formation pressure in the direction of the arrows 13 to the fluid passages 12. Power fluid, under high pressure in the annular space 1, passes in the direction of the arrows P through screens or filters 14 and 14*a*, and the power fluid inlet ports 9 into the main nozzle 10. The power fluid is jetted from the main nozzle 10 into the high velocity passage 15.

The power fluid is violently mixed with the well fluids and solids in the throat area 11 as well as in the high velocity passage 15.

The mixture comprised of power fluid, well fluids and solids then proceeds in the direction of the surface through the production tubing (not shown in FIG. 2) which extends to the production equipment at the surface.

Centralizers or spacers 21 are secured radially projecting at the casing 2 of the device.

This embodiment includes a valve-controlled access of the power fluid P to the forward nozzle or nozzles 18 and the rearward nozzle or nozzles 19.

The shown valve means includes a spring-loaded pressure valve generally identified by reference numeral 31 which can be activated by the pressure of the power fluid P. Thus, power fluid can be passed through the left-hand screen or filter 14*a* into the hollow valve member 32 which is biased by spring 33. The power fluid then passes through the passages 34 and 35 to the forward nozzle or nozzles 18. When applied with sufficient pressure to move the valve member 32 in downward direction, power fluid can also pass through passage 36 and the duct 37 to provide a remote-control cleaning mode of nozzle 19. Thus, as a function of the power fluid pressure the valve 31 is activated to admit the fluid to the lower nozzle(s) 18, or the upper nozzle(s) 19.

The tension of the spring 33 can be adjusted by a regulator 38.

Other valve types can be used, e.g., sliding sleeve activated valves wherein the centralizers 21 can be used for the purpose of activating the valve.

Figure 2A:
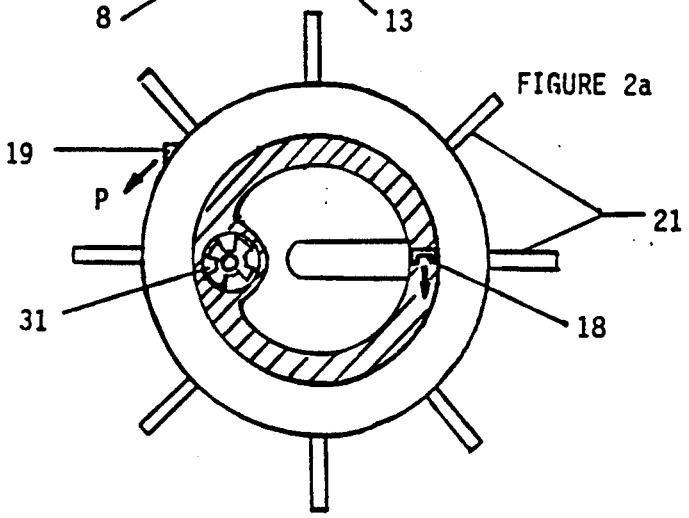
FIG. 2*a* is a bottom plan view of the device according to FIG. 2.

With reference to FIG. 2*a*, the front or forward nozzle 18 is located so as to emit a tangentially directed flow of power fluid P. The rearward nozzle 19 is placed in an analogous manner.

The embodiment shown in FIG. 2 represents the pumping mode of the device.

Diluents, surfactants, scaling inhibitors and other suitable chemicals, hot fluids, or gasses may be employed alone or in combination with regular power fluids. These may be introduced through the power fluid line or an additional fluid supply line or lines to supply a selected fluid directly to the upper and/or lower cleaning nozzles.

FIG. 3 shows the application of the device in a horizontal well, i.e., a well having a vertical or curved access portion and a generally horizontal portion. The horizontal portion of the well designated by reference numeral 43 is the area most likely to become plugged with sand and other solids materials to impede injection and production. Thus, removal of the accumulated solids, sand or other sediments, will have to be performed to make further operations in the wellbore 43 feasible.

The device according to FIG. 3 is equipped for forward and reverse cleaning modes and the pumping mode mentioned with reference to FIG. 2.

In the forward cleaning mode (as indicated by arrow 42) the front end cleaning nozzle(s) of the device are acting as described before to agitate and break up solids. In the reverse cleaning mode, when pulling the device 42 in rearward direction (arrow 42*b*), the rearward nozzles of the device, as described above, can be active to agitate and help to remove solids in the path of the device 42 and prevent it from becoming stuck in the well 43. The pumping position of the device 42 is indicated by arrow 42*c*.

FIG. 3 shows particularly the swirling or spiral movement of the power fluid as ejected from the cleaning nozzles, as described before.

The cleaning and pumping device 42 can have a spike or guide 49 forwardly in the center, as a means to prevent the device 42 from entering locations in well 43 plugged with solids and not agitated by the cleaning/-power fluid.

Thus, a permanent hydraulic connection is provided between a source of power fluid 41 and the well cleaning device 42 by coaxially-arranged endless tubing 44 and 44*a*. The co-axial tubing 44 and 44*a* is stored on a truck 45 and run in or pulled out of the well by an injector 46 through a packer 46*a*. The power fluid is supplied to a pump 47 from the source or supply tank 41. Pump 47 brings the power fluid up, to meet the operating pressure requirement of the cleaning device 42. The power fluid is then pumped from the pump 47 to the device 42 through the coaxial endless tubing 44, particularly the annulus 44*b* between the outer tubing 44 and the inner tubing 44*a*.

The inner tubing 44*a* is used to convey the mixture of well fluids and solids from the well cleaning device 42 to a settling tank 48 on the surface. The fluid is then recirculated from the settling tank 48 back to the power fluid source tank 41.

While a coaxial tubing 44 and 44*a* has been shown, tubing arranged in parallel mode may also be employed to convey the respective fluids.

Figure 4:
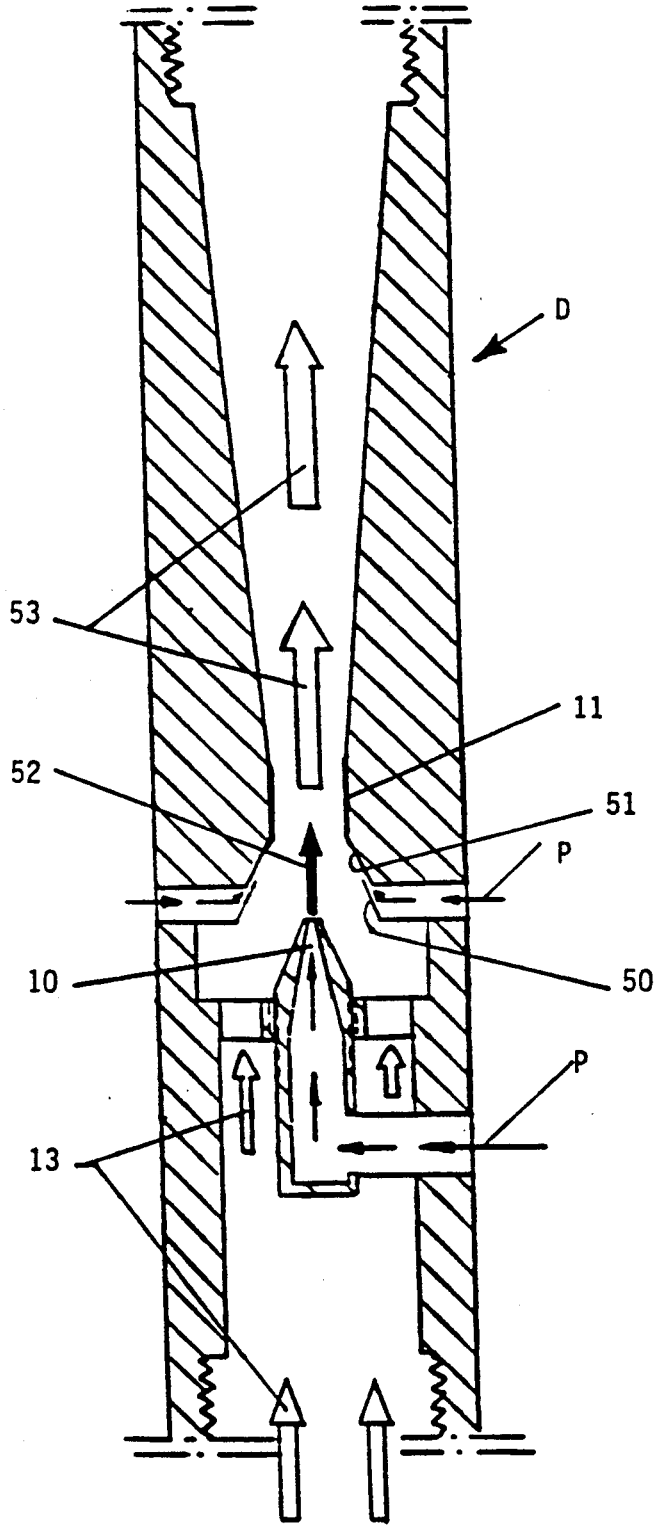
FIG. 4 is a schematic cross section of details for protecting a venturi throat in the device.

FIG. 4 shows a simplified outline of the cleaning and pumping device D which operates as described hereinabove. It further includes a cone or shield 50 which is positioned so that the power fluid P produces a liquid film or fluid shield for the venturi inlet 51 and the throat 11. The liquid film protects the venturi throat 11 in the region or zone where the high-velocity power fluid P (represented by arrow 52) emanating from nozzle 10 mixes violently with a mixture of production fluids and solids (arrows 13 represent this latter stream). The resultant combined mixture (arrows 53) is then pumped to the surface.

Figure 5:
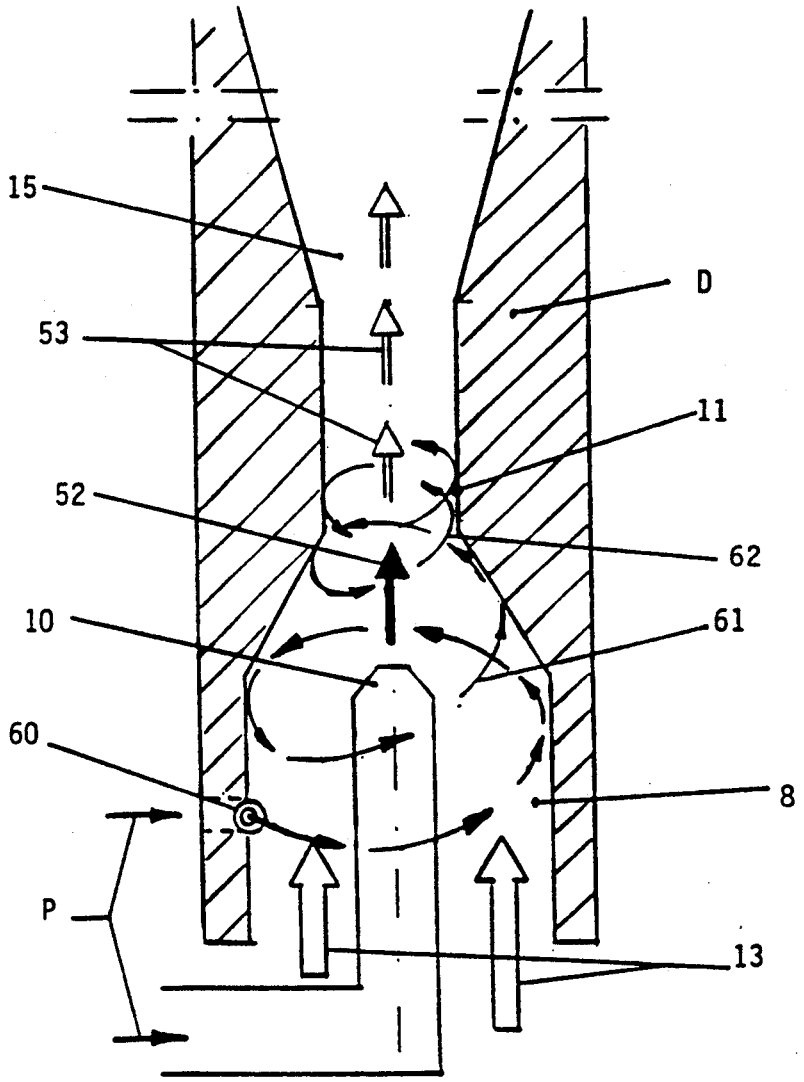
FIG. 5 is a cross section similar to FIG. 4 showing a single nozzle arrangement for protecting a venturi throat in the device.

FIG. 5 presents a device D with a nozzle or nozzles 60 placed tangentially to the circular shape of the well fluids inlet port 8. The direction of the nozzle(s) 60 and the jetting fluid stream can be adjusted to allow for a jetting of a stream from a respective nozzle 60 under various angles.

A preferred direction of the jetting stream(s) from the nozzle(s) 60 is upwards (arrow 61), i.e., accordingly to a flow of production fluids 13 and discharged power fluid 52 from the main nozzle 10 toward high-velocity passage or diffuser 15. This jetted stream 61 will create a spinning vortex 62 which produces a fluid shield 62 to protect the pump venturi throat 11 against the abrasive mixture of production fluids and solids, arrows 53, and-/or will increase the pump intake pressure to prevent cavitation at the throat 11.

Figure 5A:
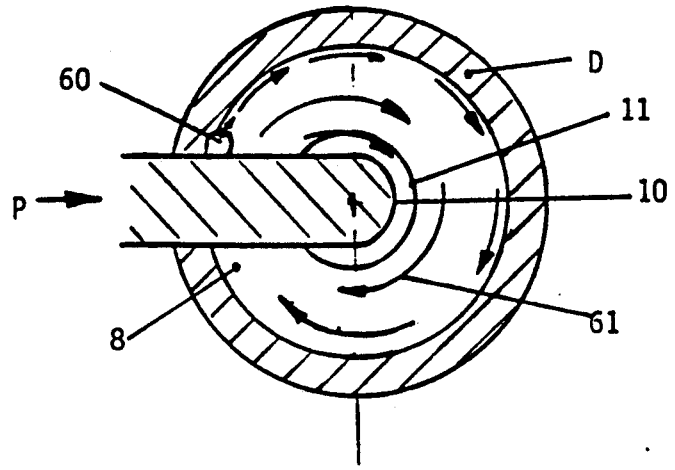
FIG. 5*a* is a bottom view of the embodiment of FIG. 5.

FIG. 5*a* shows the bottom end view of the device D according to FIG. 5. The nozzle 60 is placed in the annulus between the main nozzle 10 and the outer shell of the device D. The nozzle 60 produces a tangentially directed jet resulting in spinning of the jetted fluid due to the circular shape of the well fluids intake 8, as shown by arrow 61 to protect the venturi throat 11.

FIG. 6 shows a general outline of the device D and which includes rotating arms 70 with nozzle(s) 71. Blades 72 can rotate with the arms 70. The blades 72 and the jetting stream(s) will enhance agitation and dispersion of solids prior to pumping them up. These blades will be made from a suitable material to withstand the impact of solids particles.

The rotating motion of arms 70, in either direction, is provided by energy of the power fluid P as it enters the main nozzle 10 as well as rotating arms fluid passage 73 through a turbine 74 providing the rotating motion of the arms 70.

FIG. 6*a* presents the bottom view of the four rotating arms 70 with the nozzles 71 and attached blades 72. The power fluid admitted to the nozzles 71 can be used to rotate the arms 70 and/or blades 72. However, the rotation of the arms 70 and blades 72 can also be provided by energy of fluid (arrow 75) jetted from nozzles 71 against the well-bore casing.

As indicated by the arrow 76, for this case, the rotation of the arms 70 is opposite to the direction of the jetted fluid (75) as the fluid jets provide the energy to rotate the arms 70.

Figure 7:
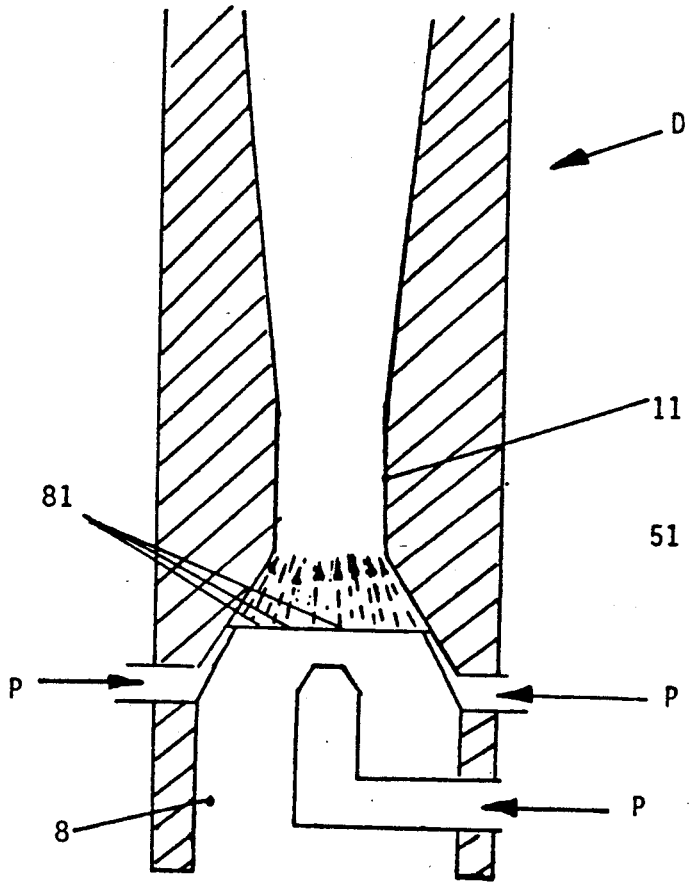
FIG. 7 is a side elevation of a plurality of nozzles to provide a fluid shield at the venturi throat.
Figure 7A:
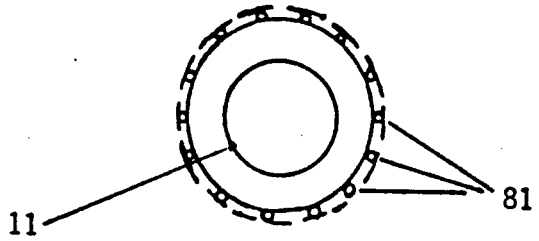
FIG. 7*a* is a bottom view of the embodiment of FIG. 7.

FIGS. 7 and 7*a* show an arrangement of nozzles 81 whose streams produce a fluid shield for the venturi inlet 51 and the venturi throat 11. These streams start separately from nozzles 81 in circular manner, see FIG. 7*a*, and consolidate in a conical shape to provide full protection of the venturi inlet 51 and throat 11. This is attained because the streams are merging on moving into the smaller diameter of the venturi throat 11.

Figure 8:
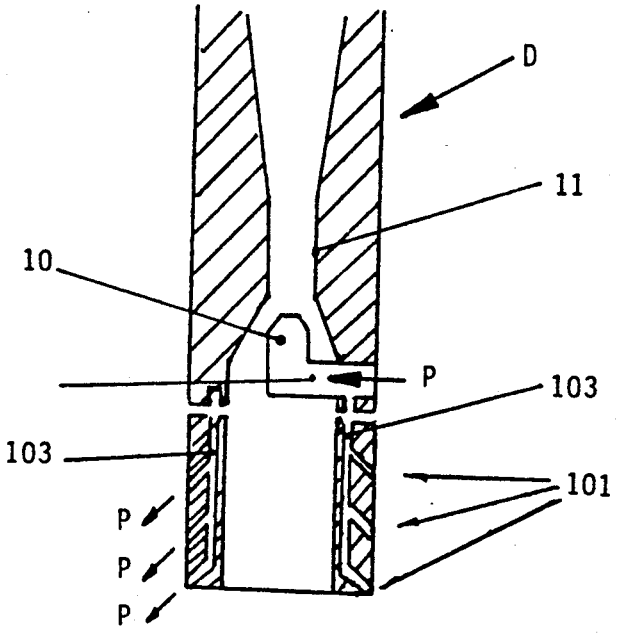
FIG. 8 is a side elevation of a rotating cleaning head.
Figure 8A:
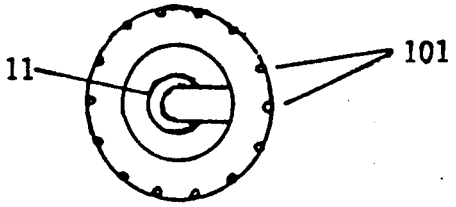
FIG. 8*a* is a bottom view of the embodiment of FIG. 8.

FIGS. 8 and 8*a* show a rotating head 100 with cleaning nozzles 101. Annular passage 103 allows distribution of power fluid P to the cleaning nozzles 101.

Figure 9:
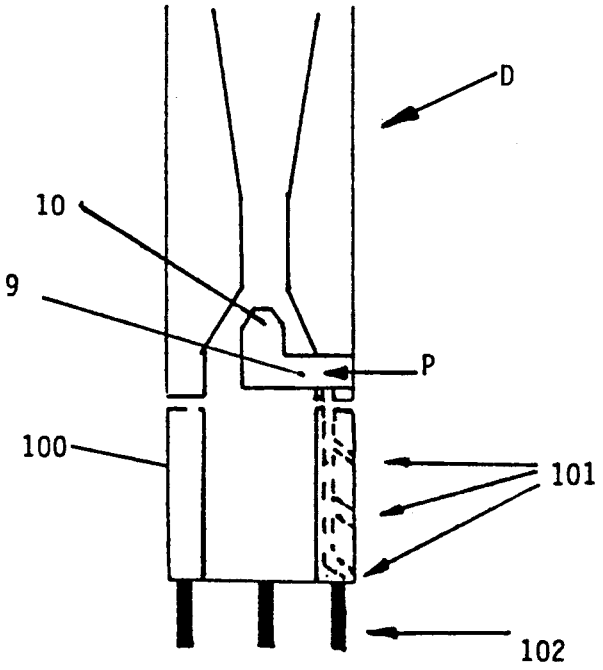
FIG. 9 is a side elevation of a further nozzle and blades arrangement.
Figure 9A:
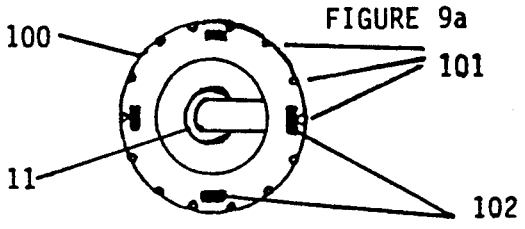
FIG. 9*a* is a bottom view of the embodiment of FIG. 9.

FIGS. 9 and 9*a* present a rotating pump head 100 with nozzle(s) 101 and attached blades 102 which rotate with the head 100. The blades 102 and the jetting stream(s) will enhance agitation and dispersion of solids prior to pumping them up. These blades 102 are made from a suitable material to withstand the impact of solids particles.

Figure 10:
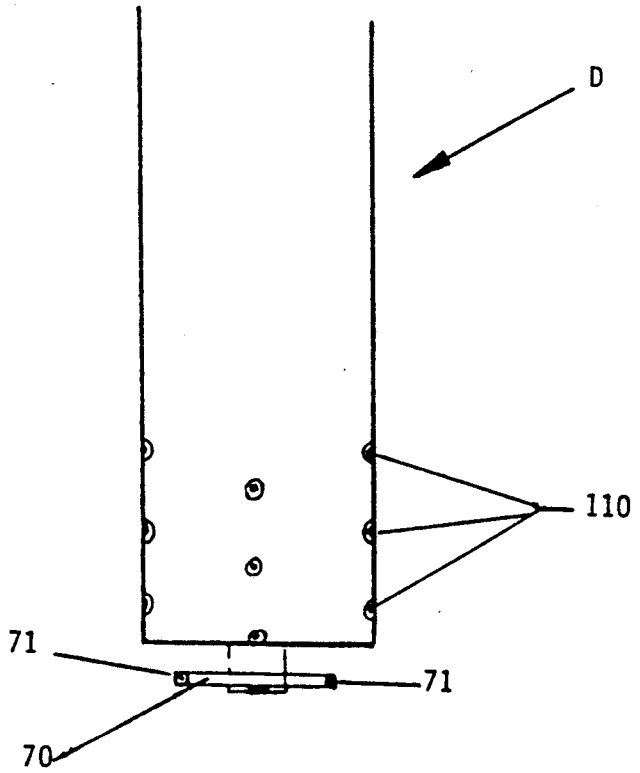
FIG. 10 is a side elevation of an arrangement of stationary and rotating cleaning nozzles.
Figure 10A:
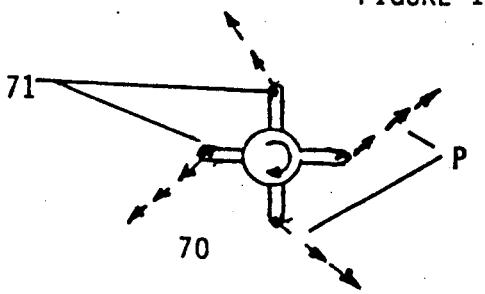
FIG. 10*a* is a bottom view of the embodiment of FIG. 10.

FIGS. 10 and 10*a* present an arrangement with stationary nozzles 110 and rotatably mounted arms 70 which have cleaning nozzles 71. This arrangement provides a suitable option for cleaning a horizontal well.

Advantages of my invention:

1. The unit has the capacity of serving as a production unit at the same time or alternately with its cleaning function.

2. The device can clean during run-in an pull-out operations.

3. The spinning effect achieved by respective jets improves the pump performance and decreases wear of the pump components as the production fluids are well mixed and solids are dispersed into fines.

4. The centralizers can prevent the device from becoming stuck in a conduit.

5. Diluent, hot water or special fluid can be supplied with the power fluid or through a separate line to the upper and/or lower nozzle(s) for the purpose of agitating and mixing low viscosity oil and/or sand for the purpose of lowering the production fluid viscosity prior to its entry to the pump throat area and being pumped out.

6. A water solution of a surfactant or blend of surfactants either alone or with hydrocarbon diluent injected by nozzle(s) just before the pump's throat to wet the surface and provide a protection from cavitation, wear or erosion by solids-bearing fluids.

7. As well, special fluids, e.g. hydrofluoric acid, may be utilized to enhance the action of dispersing and fluidizing solids by the jets.

While the invention has been described in the specific as the application of cleaning a well-bore, other applications will occur to those skilled in the art. These principles may be utilized in restoring the service of numerous other vertical or deviated conduits.

What is claimed is:

1. A device for removing solids from a conduit, which device comprises:

a jet pump including a pump body, a main nozzle, and at least one cleaning nozzle for bringing a power fluid to said solids;

passage means in said device for flowing power fluid to said main nozzle and to said at least one cleaning nozzle, whereby said at least one cleaning nozzle directs said power fluid in a high-velocity jet against said solids to bring said solids into suspension for subsequent removal of said solids by said jet pump; and pressure responsive variable flow valve means responsive to the power fluid pressure and located in said pump body and connected in fluid communication with said at least one cleaning nozzle and said source of power fluid.

2. The device of claim 1, wherein a plurality of cleaning nozzles is used and each directs a high-velocity fluid jet against sedimented solids for dispersing and fluidizing said solids and removal thereof to the surface through said pump body.

3. The device of claim 2, wherein at least one additional nozzle is arranged in the pump body in a manner to direct power fluid mixed with an agent to provide a protective film in said pump body.

4. The device of claim 1, wherein said at least one cleaning nozzle is arranged to provide a forwardly directed high-velocity jet.

5. The device of claim 1, wherein said at least one cleaning nozzle is arranged to provide a tangentially directed high-velocity spinning jet.

6. The device of claim 1, wherein said at least one cleaning nozzle is located forwardly of said main nozzle.

7. The device of claim 1, wherein said at least one cleaning nozzle is located rearwardly of said main nozzle.

8. The device of claim 1, wherein said at least one cleaning nozzle is located at the pump body lower circumference.

9. The device of claim 1, wherein said at least one cleaning nozzle is located at the pump body lower circumference near the centre of the produced fluid entry of said pump body.

10. The device of claim 1, and further including means for rotatably mounting said at least one cleaning nozzle on said pump body.

11. The device of claim 10, wherein said means is a rotating head connected to said pump body.

12. The device of claim 1, which includes external centralizers secured exteriorly at said pump body to prevent the device from becoming stuck in said conduit.

13. The device of claim 1, which includes a forwardly directed spoke connected at said pump body.

14. A device for removing fluidized solids from a conduit, which device comprises:

a jet pump, said jet pump including a pump body having walls defining a venturi throat, a main nozzle, and at least one nozzle located in said pump body for directing power fluid against the wall of said venturi throat; and passage means in said device for flowing power fluid to said jet pump and to said at least one nozzle to produce a liquid film for protection of said venturi throat against the abrasive action of the stream of fluidized solids which is being pumped up to the surface.

15. The device of claim 14, and further including shield means for producing said liquid film.

16. The device of claim 14, wherein said liquid film substantially precludes cavitation at said venturi throat.

17. A device for removing solids from a conduit, which device comprises:

a jet pump, said jet pump including a pump body having walls defining a venturi throat, a main nozzle, and at least one nozzle located in said pump body for directing power fluid against the wall of said venturi throat;

passage means in said device for flowing power fluid to said jet pump and to said at least one nozzle to produce a liquid film for protection of said venturi throat against the abrasive action of the stream of fluidized solids which is being pumped up to the surface; and at least one cleaning nozzle for bringing power fluid to said solids.

18. A method of removing solids from a conduit, which includes providing a string of tubing for supplying a power fluid to a plugged location in said conduit;

connecting to said string of tubing a device which comprises: a jet pump having a pump body, a main nozzle, and at least one cleaning nozzle for bringing a power fluid to said solids; passage means in said device for flowing power fluid to said main nozzle and to said at least one cleaning nozzle, whereby said at least one cleaning nozzle directs said power fluid in a high-velocity jet against said solids to bring said solids into suspension for subsequent removal of said solids by said jet pump; and pressure responsive variable flow valve means responsive to the power fluid pressure and located in said pump body and connected in fluid communication with said at least one cleaning nozzle and said source of power fluid;

advancing said device to the plugged location;

subjecting the plugged location to jetting action of power fluid; and removing solids from said plugged location through said device.

19. The method of claim 18, wherein said device is reciprocatingly moved in a well.

20. The method of claim 18, wherein said device is moved in and out in a well.

21. The method of claim 18, wherein said power fluid includes at least one admixture.

22. The method of claim 21, wherein said admixture is a reagent to remove scaling.

23. The method of claim 21, wherein said admixture is a reagent to preclude scaling.

24. The method of claim 18, and further including varying the size of said at least one cleaning nozzle to adjust the intensity of the high-velocity jet emanating therefrom.

25. A method of removing solids from a conduit, which includes providing a string of tubing for supplying a power fluid to a plugged location in said conduit;

connecting to said string of tubing a device, which device comprises: a jet pump, said jet pump including a pump body having walls defining a venturi throat, a main nozzle, and at least one nozzle located in said pump body for directing power fluid against the wall of said venturi throat; and passage means in said device for flowing power fluid to said jet pump and to said at least one nozzle to produce a liquid film for protection of said venturi throat against the abrasive action of the stream of fluidized solids which is being pumped up to the surface;

advancing said device to the plugged location;

subjecting the plugged location to jetting action of power fluid; and removing solids from said plugged location through said device.

26. A method of removing solids from a conduit, which includes providing a string of tubing for supplying a power fluid to a plugged location in said conduit;

connecting to said string of tubing a device, which device comprises: a jet pump, said jet pump including a pump body having walls defining a venturi throat, a main nozzle, and at least one nozzle located in said pump body for directing power fluid against the wall of said venturi throat; passage means in said device for flowing power fluid to said jet pump and to said at least one nozzle to produce a liquid film for protection of said venturi throat against the abrasive action of the stream of fluidized solids which is being pumped up to the surface; and at least one cleaning nozzle for bringing power fluid to said solids;

advancing said device to the plugged location;

subjecting the plugged location to jetting action of power fluid; and removing solids from said plugged location through said device.

* * * * *